US006510775B2

(12) United States Patent
Emmerich

(10) Patent No.: US 6,510,775 B2
(45) Date of Patent: Jan. 28, 2003

(54) BRAIDING MACHINE AND METHOD OF OPERATING SAME

(76) Inventor: Wolfgang Emmerich, Braamer Strasse 99, D-31061 Hamm (DE)

( * ) Notice: Subject to any disclaimer, the term of this patent is extended or adjusted under 35 U.S.C. 154(b) by 0 days.

(21) Appl. No.: 09/824,520

(22) Filed: Apr. 2, 2001

(65) Prior Publication Data

US 2002/0046641 A1 Apr. 25, 2002

(30) Foreign Application Priority Data

Mar. 31, 2000 (DE) ..... 100 15 996

(51) Int. Cl.[7] ..... D04L 3/00
(52) U.S. Cl. ..... 87/33
(58) Field of Search ..... 82/62; 87/14, 33, 87/44, 62; 139/1 R

(56) References Cited

U.S. PATENT DOCUMENTS 3,640,176 A * 2/1972 Gaul ..... 87/33
4,336,903 A 6/1982 Zirps
5,715,734 A * 2/1998 Emmerich et al. ..... 82/62

FOREIGN PATENT DOCUMENTS

DE 41 11 553 10/1992
DE 19523721 C1 * 8/1996
DE 195 23 721 8/1996
JP 03209508 A * 9/1991
JP 2000265348 A * 9/2000

OTHER PUBLICATIONS

"Bearing Temperature Controller" JP3209508, Sep. 12, 1991, Takada Hirotoshi, 3 pages.

* cited by examiner

*Primary Examiner*—John J. Calvert
*Assistant Examiner*—Shaun R Hurley
(74) *Attorney, Agent, or Firm*—Herbert Dubno; Andrew Wilford

(57) ABSTRACT

A braiding machine has a support defining an upright axis, a lower rotor rotatable on the support about the axis and defining an annular guide centered on the axis, and an upper rotor having slides bearing at an interface on the guide and rotatable on the lower rotor about the axis. A drive connected to the rotors rotates same in opposite directions about the axis with the slides sliding on the guide. Dosers feeding a lubricant to the interface and a sensor detects a temperature of the guide at the interface. A computer-type controller connected to the doser and to the sensor feeds the lubricant to the interface at a rate only sufficient to prevent the detected temperature from exceeding a predetermined limit.

11 Claims, 4 Drawing Sheets

BRAIDING MACHINE AND METHOD OF OPERATING SAME

FIELD OF THE INVENTION

The present invention relates to a braiding or lace-making machine. This invention also concerns a method of operating such a machine.

BACKGROUND OF THE INVENTION

A standard braiding machine has a stationary base on which is supported a lower ring rotor centered on and rotatable about a vertical axis. This lower ring carries an annular array of filament supplies and has a guide with an annular upwardly directed surface centered on the axis. An upper rotor centered on the axis has slides riding on the lower ring surface and itself carries an annular array of filament supplies. A drive is connected to the rotors to rotate them in opposite directions about the axis so that the upper ring slides on the lower ring. Filaments are pulled axially up off the supplies to form a central braid, typically a cable or hose.

The upper slides and the lower-ring guide can therefore move relative to each other at very high speed. In a system working at 150 RPM the relative speed can be as much as 5 m/sec. Since this is a simple slide joint, it is essential to lubricate the interface between the guide and slides to prevent excessive heat build-up and wear. Thus systems are provided which pump a lubricant oil of some sort to the slide joint, normally at several sites spaced angularly around it.

The problem with this system is that if insufficient lubricant is applied, the joint will heat and possible seize up. Alternately if too much lubricant is pumped into the joints, it will be driven centrifugally out and can contaminate the filaments being braided together. While in a system making a bridge cable, some oil might not be a problem, when the braid is intended for medical use, it must be perfectly clean so no such contamination is permitted. Providing the right amount of lubricant is therefore a delicate problem.

German patent 4,111,553 of J. Lache proposes a system with individual piston-type dosing units for the individual lubrication sites that allow very accurate control of the amount of lubricant dispensed at these sites. Experimentation determines the right amount which is then normally set for an entire operational cycle, with at most the worker checking in to see if lubricant was being sprayed out, in which case the dose would be decreased, or the joint was drying out, in which case the dose would be increased. The system required close monitoring by the operational personnel add at best approximated the ideal level of lubrication.

German patent 195 23 721 of J. Lache has pressure-increasing units provided near the individual lubrication sites. These units take over the role of the individual dosers of above cited German '553. The pressure-increasing units are operated by pulses whose frequency increases with rotation rate of the braiding machine, to produce some sort of correspondence between lubrication rate and lubrication need. Since, however, such units must operate at a certain minimum pressure, they cannot readily accommodate low rotation speeds or particularly light rotors, so that in these cases the lubrication is often excessive, spraying droplets of oil onto the workpiece.

OBJECTS OF THE INVENTION

It is therefore an object of the present invention to provide an improved braiding machine.

A further object is the provision of an improved method of operating a braiding machine.

Another object is an improved braiding system where the machine is lubricated sufficiently to reduce wear but not so much as to allow excess lubricant to soil the workpiece.

SUMMARY OF THE INVENTION

A braiding machine has a pair of rotors that are rotated relative to each other with one of the rotors forming a guide on which slides of the other rotor slide. A temperature of an interface between the slides and guide is continuously monitored. Lubricant to the interface at a rate only sufficient to prevent the sensed temperature from exceeding a predetermined limit.

Thus with this system a desired operating temperature, e.g. 60° C., at the interface is established and, when the temperature starts to rise above this level the lubricant-feed rate is increased. If the temperature starts to drop, the lubricant-feed rate is decreased. In this manner the system avoids the standard practice of simply feeding in so much lubricant that the slides and guide are protected, even though in many cases this is so much extra lubricant that it sprays radially out from the slide/guide interface and contaminates the filaments.

It is known from Japanese patent document 32 09 508 of Takada Hirotoshi to provide a temperature-sensitive valve for dispensing a lubricant in accordance with the temperature at the valve, but such a system cannot be mounted on the rotor of a braiding machine. Similarly U.S. Pat. No. 4,336,905 of Zirps describes a control valve for maintaining a pressure medium at a constant temperature and viscosity, but such an arrangement is also not suitable for mounting in a braiding machine.

The load exerted by the rotors on a drive rotating the rotors is monitored according to the invention. Thus if, for instance, the filament being braided sheds abrasive particles that get into the slide/guide interface, the system will be able to respond with extra lubrication, preventing excess wear of these parts even if they are not overheating. This load-responsive system is also advantageous to compensate for a momentary high load, as for instance if something gets caught briefly in the interface.

The rate is also varied in accordance with the monitored drive load. Thus as the supplies of filament carried by the rotors, typically large spools of cord or wire, are used up and the rotors get lighter, the lubrication rate is adjusted downward as there is less pressure at the slide/guide interface.

The controller according to the invention can also vary drive speed if necessary, for instance in case of a blockage. Furthermore a cooling fan can be operated by the controller in certain circumstances.

Similarly a rotation speed of the drive rotating the rotors can be monitored so as to vary the rate in accordance with the monitored drive speed. Thus until the system gets up to speed, the lubrication level is held low. This speed-responsive system is particularly important in determining the minimum lubrication level needed by the machine.

It is also possible to vary the rate in accordance with an inputted weight of the rotors. Thus the operator of the machine keyboards into the controller the number of filament supplies and how much each one weighs so the machine knows right from the start how much friction it will be dealing with.

The lubricant is fed in accordance with the invention in separate doses at intervals and the lengths of the intervals are varied to change the lubricant-feed rate. Thus each dose is the same; it is the time between doses that is varied. This dosing is done by turning on and off a pump.

Furthermore according to the invention an output is generated corresponding to the sensed temperature at the interface and the output is compared with a set point to establish the lubricant-feed rate.

The braiding machine according to the invention therefore has a support defining an upright axis, a lower rotor rotatable on the support about the axis and defining an annular guide centered on the axis, and an upper rotor having slides bearing at an interface on the guide and rotatable on the lower rotor about the axis. A drive connected to the rotors rotates same in opposite directions about the axis with the slides sliding on the guide. Dosers feed a lubricant to the interface and a sensor detects a temperature of the guide at the interface. A computer-type controller connected to the doser and to the sensor feeds the lubricant to the interface at a rate only sufficient to prevent the detected temperature from exceeding a predetermined limit.

The controller is connected to the drive for varying the lubricant-feed rate in accordance with rotor speed. This can be done by means of a frequency converter connected to the drive motor. Similarly the controller can be connected to the drive for varying the lubricant-feed rate in accordance with a load the rotors exert on the drive.

The dosing system includes a lubricant supply and a pump connected thereto. The controller periodically actuates the pump to force lubricant into the interface.

This interface according to the invention is provided with a plurality of lubricating sites. The dosing system includes respective pressure-operated dosers connected to the sites and to the pump.

The sensor is fixed in the guide and conductors including commutator rings on the lower rotor connect the sensor to the controller.

The system of this invention can be applied to a standard or figure-type braiding machine. It can also be used on machines for knitting, weaving, or making bone lace.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
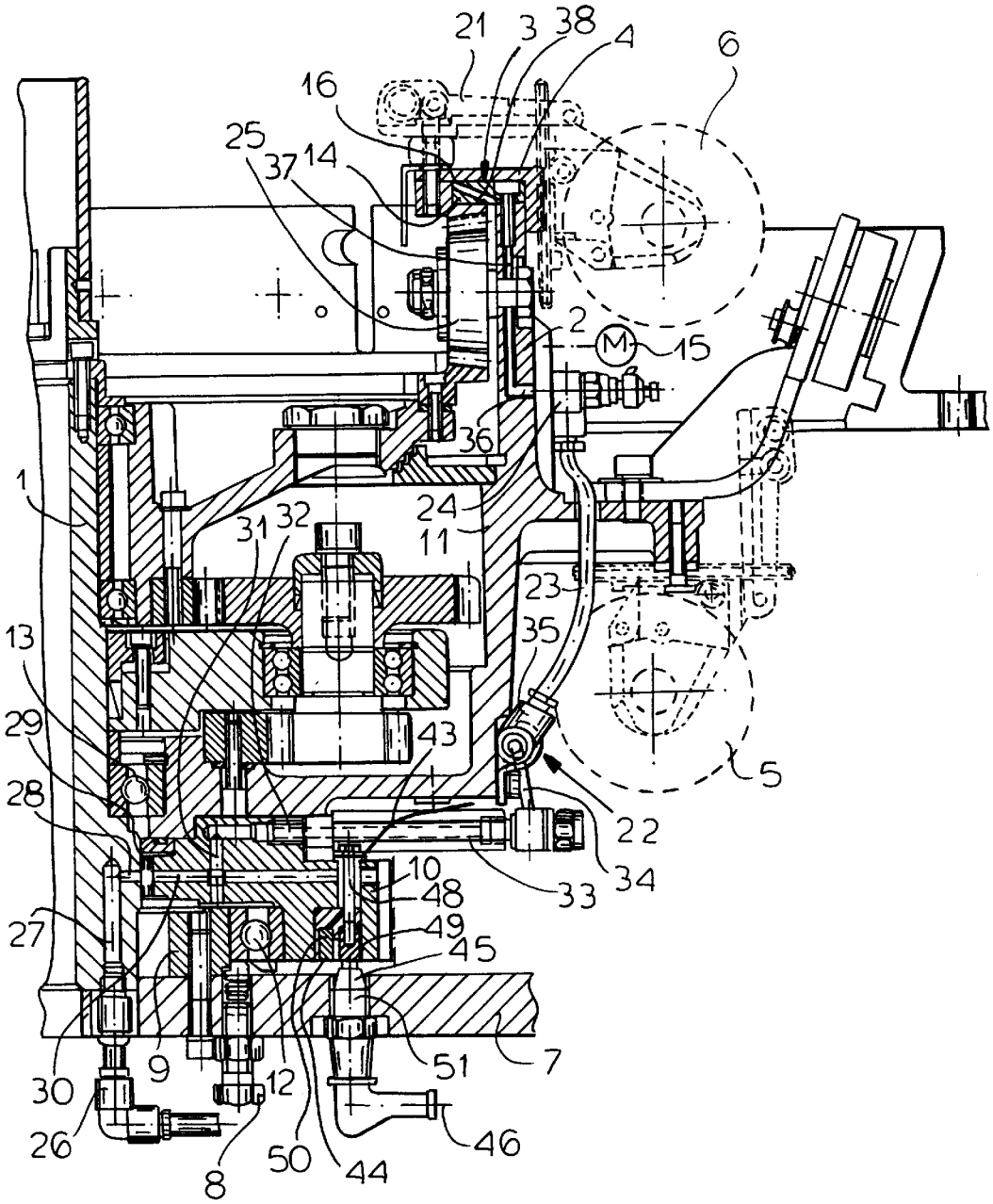
FIG. 1 is a partly diagrammatic vertical section through a braiding machine according to the invention.
Figure 2:
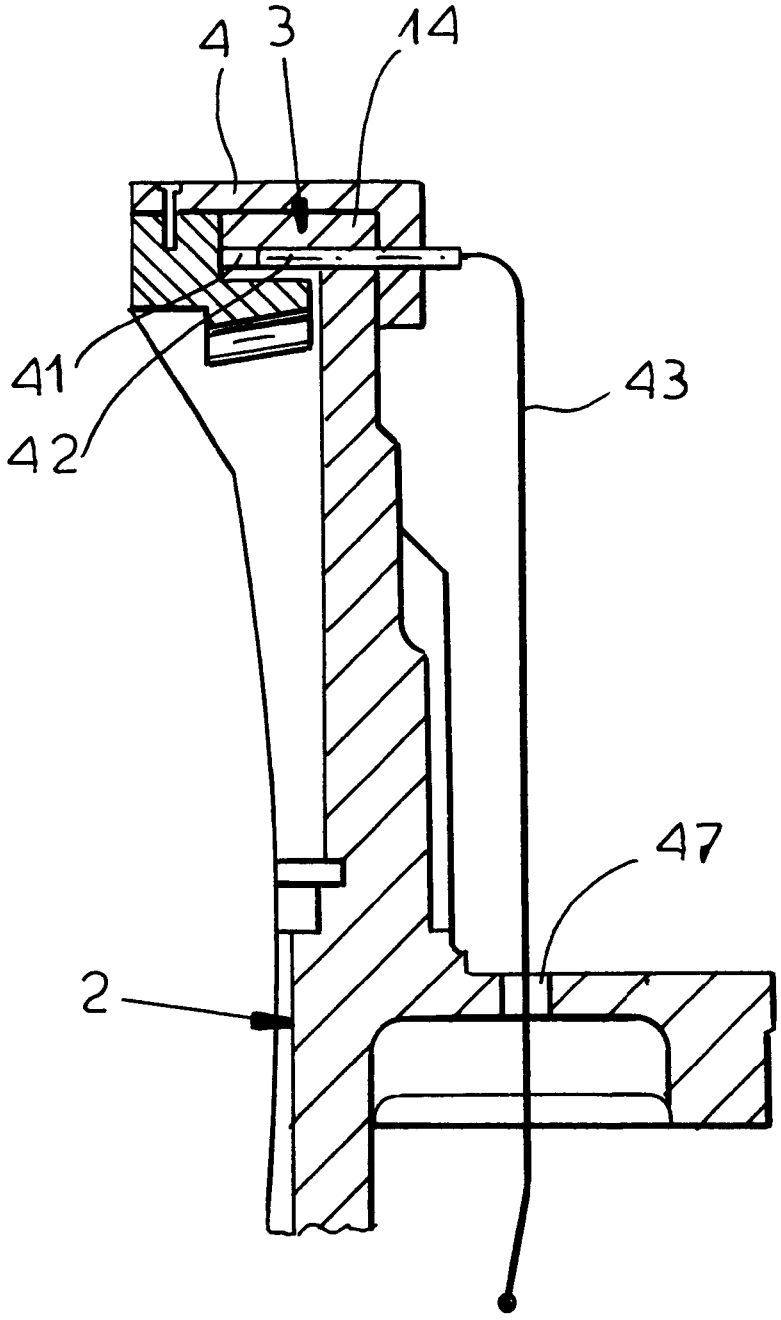
FIG. 2 is another sectional detail of the braiding machine.
Figure 3:
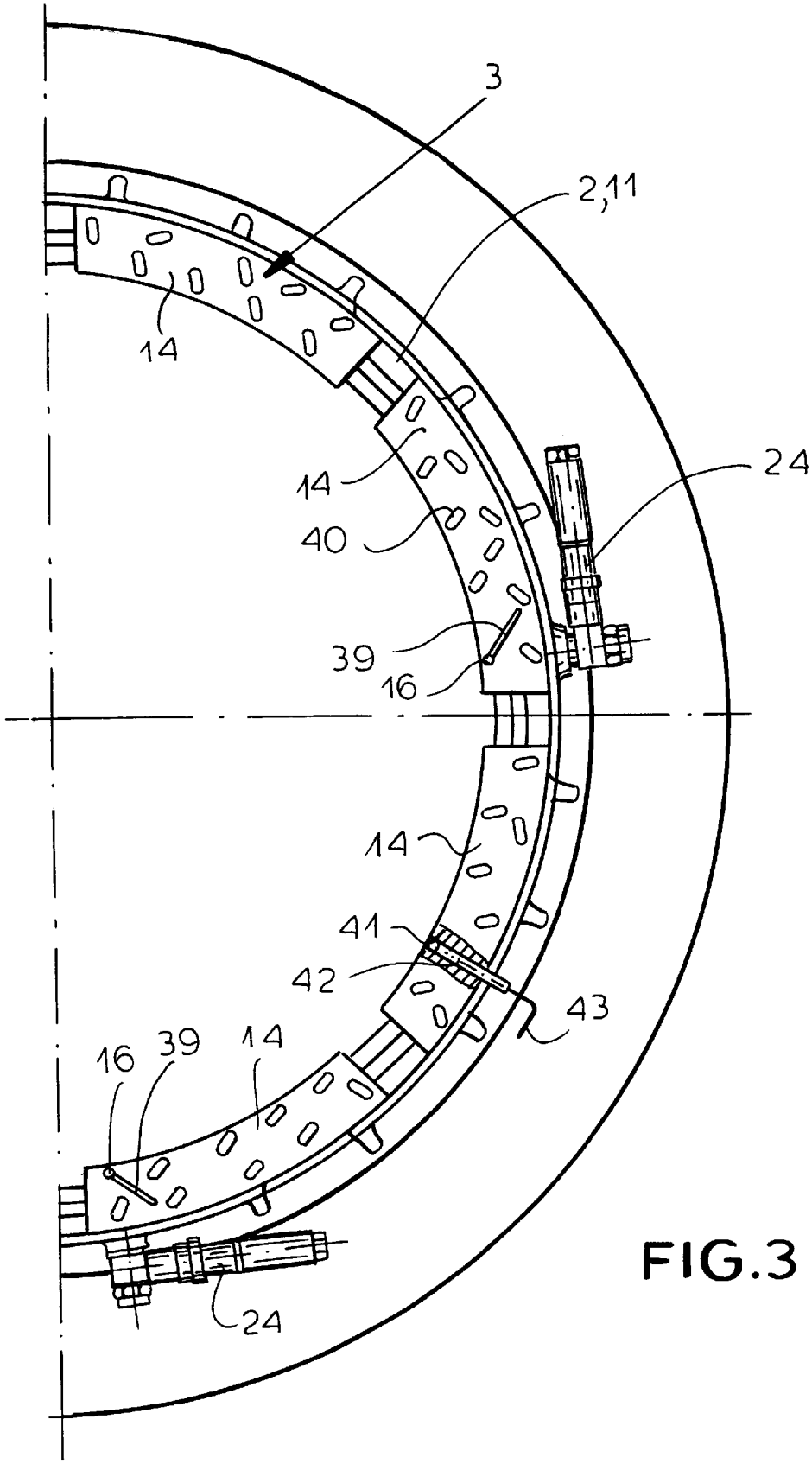
FIG. 3 is a top view of the structure of FIG. 1.

As seen in FIGS. 1 through 3 a braiding machine has a stationary support hub 1 centered on an upright axis A and carrying a lower rotor 2 centered on the axis A and rotatable thereabout. The rotor 2 has an upper part 11 provided with a guide ring 3 on which are supported eight slides 4 of an upper rotor 21. An array of filament supplies shown schematically at 5 is supported on the rotor 2 and other supplies shown schematically at 6 are supported on the respective the slides 4. A drive indicated schematically at 15 is connected to the rotor 2 and via pinion gears 25 carried thereon and meshing with ring gears on the rotors 2 and 21 to the rotor 21 to rotate both the rotors 2 and 21 oppositely about the axis A.

The guide 3 is formed by eight identical segments 14 spaced to allow filaments from the lower supplies 5 to pass and each of substantially rectangular section. The slides 4 complementarily surround all four sides of the guide 3 except at an outer portion of the lower surface where the segments 14 are bolted to the upper portion 11 of the rotor 2. The upper portion 11 of the rotor 2 has a lower portion supported via an upper roller bearing 13 on the stationary support hub 1 and fixed to a lower part 10 of the rotor 2 carried by a lower roller bearing 12 on a ring 9 secured by bolts 8 to a plate 7 fixed to the support hub 1.

Figure 4:
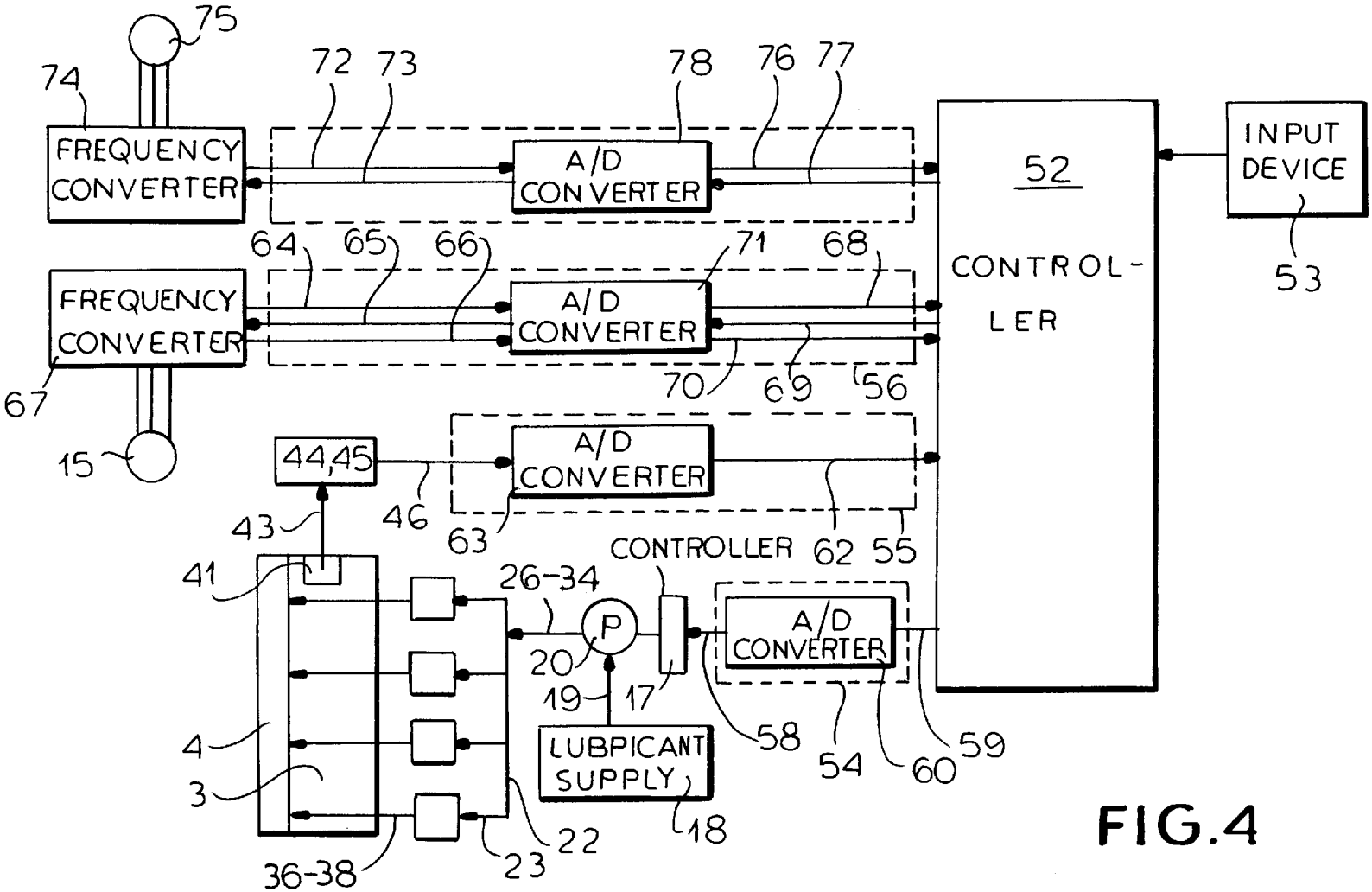
FIG. 4 is a schematic diagram illustrating the control system of this invention.

Four of the segments, that is every other segment 14 is formed at an inner portion of its leading end with a lubricant site or hole 16 communicating via a passage 38 extending diagonally through the guide 3 with a respective upright passage 37 in turn communicating via a respective radial passage 36 with a respective pressure-controlled doser 24 connected by a conduit 23 to a T-fitting 35 on a manifold 22 fixed to and extending angularly around most of the rotor 2. In turn the manifold 22 is connected via a conduit 34 and connector fitting 33 to a radial passage 32 connected via an axial passage 31 and radial passage 30 to a seal 29 and thence to a radial passage 28 in the support 1 feeding into an axial passage 27 connected to an output line 26 of a pump 20 (FIG. 4). Thus lubricant, typically oil received through a conduit 19 from a supply 18, is forced by the pump 20 into all of the dosers 24 and thence out of the holes 16 onto the tops of the guide segments 14. To distribute the lubricant, as shown in FIG. 3, the guide segments 14 with the holes 16 are formed on their planar upper faces with a diagonal distributing groove 39 extending radially outward away from the hole 16 and all of the upper surfaces are formed with oil-holding pockets 40. Side passages extending from the seal 29 also feed this oil to the bearings 12 and 13.

Alternately a pressure-increasing device such as described in U.S. Pat. No. 5,715,734 of Emmerich could be used.

In addition as shown in FIG. 2 one of the segments 14 of the guide 3 is provided with a resistance-type PT-100 sensor 41 positioned just 0.1 mm beneath the radial inner surface of the segment 14. This sensor 41 is mounted in a tube 42 and connected via a two-conductor wire 43 extending through a hole 47 in the rotor 2 to bolts 48 held in insulating sleeves 49 and connected through insulators 50 to respective commutator rings 44 (only one shown) contacted by brushes 45 secured in holders 51 in the plate 7 and connected via respective conductors 46 to control circuitry described below. Instead of this type of connection, an inductive or even radio-wave coupling could be used to connect the moving sensor 41 with its control circuitry, in that a sensor and transmitter is provided on the moving rotor 2 and a receiver on the plate 7 of the stationary hub 1. The sensor could also operate with infrared light so that it could be mounted on the support hub 1 and directed at the interface of the guide 3 and slides 4. The confronting surfaces of the guide 3 and slides 4 are highly machined or polished for minimum friction.

As shown in FIG. 4 a microprocessor controller 52 having a memory and an input device 53 is connected to units 54, 55, 56, and 57. The unit 54 comprises an analog/digital converter 60 having an input line 59 connected to the controller 52 and an output line 58 connected via a switch 17 to the pump 20 to control the rate at which the dosers 24 feed lubricant from the supply 18 to the sites 16. The input 53 can be used to supply the controller 52 with information such as the viscosity of the lubricant and the characteristics of the material being braided.

The unit 55 has another analog/digital converter 63 having an input formed by the line 46 and an output line 62 connected to the controller 52 for feeding temperature information to the controller.

Rotation speed is monitored by a frequency converter 67 operated by the motor 15 and having lines 64, 65, and 66 connected to a three-channel analog/digital converter 71 of the unit 56. Lines 68, 69, and 70 connect the converter 71 in turn to the controller 52 so same can monitor and if necessary vary the rotation speed of the rotors 2 and 21. It can also of course monitor the load on the motor 15, which load is of course related to the number and size of the spools being carried and the amount of lubrication of the slide/guide interface.

A cooling fan 75 directed at the guide 3 and slides 4 is connected via lines 72 and 73 of a frequency converter 74 to another analog/digital converter 78 of the unit 57. Lines 76 and 77 connect this converter 78 to the controller 52 so it can vary the cooling effect of the fan 75.

Thus the controller 52 monitors the actual temperature at the interface between the guide 3 and slides 4 as well as the rotation speed of the rotors 2 and 21 and the load on the drive motor 15. It can control the rate at which oil is dosed by the units 24 from the sites 16 and the amount of cooling effective by the fan 75.

In a standard system the pulse rate of the converter 60 is set to emit one spurt of lubricant from the sites 16 every 45 sec. This rate is maintained until the sensed temperature of the guide 3 is 40° C. The pulse interval is then increased to hold temperature increase to 20 per minute. Once the desired working temperature of 60° C. is attained, the pulse rate is set to keep this temperature constant, decreasing as the temperature drops and increasing as it rises. With this system even as the supplies 6 get lighter so the upper rotor 21 bears with less pressure on the lower rotor 2, the dose rate from the units 24 is adjusted to maintain even temperature at the slide/guide interface.

I claim:

1. A method of operating a braiding machine having a pair of rotors that are rotated relative to each other with one of the rotors forming a guide on which slides of the other rotor slide, the method comprising the steps of:

sensing a temperature of an interface between the slides and guide; and feeding a lubricant to the interface at a rate only sufficient to prevent the sensed temperature from exceeding a predetermined limit.

2. The operating method defined in claim 1, further comprising the steps of:

monitoring a rotation speed of the drive rotating the rotors; and varying the rate also in accordance with the monitored drive speed.

3. The operating method defined in claim 1, further comprising the step of varying the rate in accordance with an inputted weight of the rotors.

4. The operating method defined in claim 1 wherein the lubricant is fed in separate doses at intervals and the lengths of the intervals is varied to change the lubricant-feed rate.

5. The operating method defined in claim 1, further comprising the steps of generating an output corresponding to the sensed temperature at the interface; and comparing the output with a set point to establish the lubricant-feed rate.

6. A braiding machine comprising:

a support defining an upright axis;

a lower rotor rotatable on the support about the axis and defining an annular guide centered on the axis;

an upper rotor having slides bearing at an interface on the guide and rotatable on the lower rotor about the axis;

drive means connected to the rotors for rotating same in opposite directions about the axis with the slides sliding on the guide;

dosing means for feeding a lubricant to the interface;

sensor means for detecting a temperature of the guide at the interface; and control means connected to the dosing means and to the sensor means for feeding the lubricant to the interface at a rate only sufficient to prevent the detected temperature from exceeding a predetermined limit.

7. The braiding machine defined in claim 6 wherein the control means is connected to the drive means for varying the lubricant-feed rate in accordance with rotor speed.

8. The braiding machine defined in claim 6 wherein the control means is connected to the drive means for varying the lubricant-feed rate in accordance with a load the rotors exert on the drive means.

9. The braiding machine defined in claim 6 wherein the dosing means includes a lubricant supply and a pump connected thereto, the control means periodically actuating the pump to force lubricant into the interface.

10. The braiding machine defined in claim 6 wherein the interface is provided with a plurality of lubricating sites, the dosing means including respective pressure-operated dosers connected to the sites and to the pump.

11. The braiding machine defined in claim 6 wherein the sensor means includes a sensor fixed in the guide, and conductors including commutator rings on the lower rotor connecting the sensor to the control means.

* * * * *